United States Patent [19]

Werne

[11] 4,190,197

[45] Feb. 26, 1980

[54] DEVICE FOR DRAFT CONTROL

[76] Inventor: Stig Werne, Hermelinsv 13, S-43300 Partille, Sweden

[21] Appl. No.: 863,244

[22] Filed: Dec. 22, 1977

[30] Foreign Application Priority Data

Dec. 27, 1976 [SE] Sweden ..... 7614555

[51] Int. Cl.[2] ..... F23N 3/00

[52] U.S. Cl. ..... 236/1 G; 431/20

[58] Field of Search ..... 236/1 G; 110/163; 126/285 B; 431/20

[56] References Cited

U.S. PATENT DOCUMENTS

| | | | |
|---|---|---|---|
| 2,154,644 | 4/1939 | Sweatt | 236/1 G X |
| 2,259,973 | 10/1941 | Firehammer | 236/1 G X |
| 3,197,139 | 7/1965 | Diermayer et al. | 236/1 G |
| 4,046,318 | 9/1977 | Ripley | 236/1 G |

*Primary Examiner*—William F. O'Dea
*Assistant Examiner*—William E. Tapolcai, Jr.

[57] ABSTRACT

Device for automatic draft control of a furnace having an oil burner, a smoke flue, and an exhaust valve located in the smoke flue, part of said smoke flue comprising a metal tube which is connected with the wall of a chimney, said device comprising a first sensoring device provided on said metal tube and subjected to the influence of the temperature prevailing in said tube, and a second sensoring device provided in said chimney wall, said first and second sensoring devices being connected with the exhaust valve in such a manner that their combined registration is transmitted to the exhaust valve.

7 Claims, 2 Drawing Figures

DEVICE FOR DRAFT CONTROL

The present invention relates to a device for automatic draft control in connection with furnaces provided with oil burners.

It has turned out that with conventional means it is very difficult to obtain a correct mixture of oil and air that lasts during the whole burning period of the oil burner, which means the time that passes between switching on and shutting off the electric current supply to the burner.

At the start of the burner a greater quantity of air is required than during the later part of the burning period, which can be divided up in two parts, i.e. the ignition and heating-up phase and the operating phase.

It is a principal object of the invention to provide an automatic draft control, by means of which correct conditions of combustion are obtained during the heating-up as well as during the operating phase. This object is reached by means of a device according to the invention, which substantially is characterized by comprising at least one sensoring device subjected to the influence of the temperature prevailing in the smoke exhaust pipe of the furnace and means for the transmission of the registration of the sensor to an exhaust valve provided in the smoke flue, so that said valve can be brought to move in the shutting-off direction in connection with an increased temperature in the smoke flue and in the reverse direction, when the temperature is decreasing.

Figure 1:
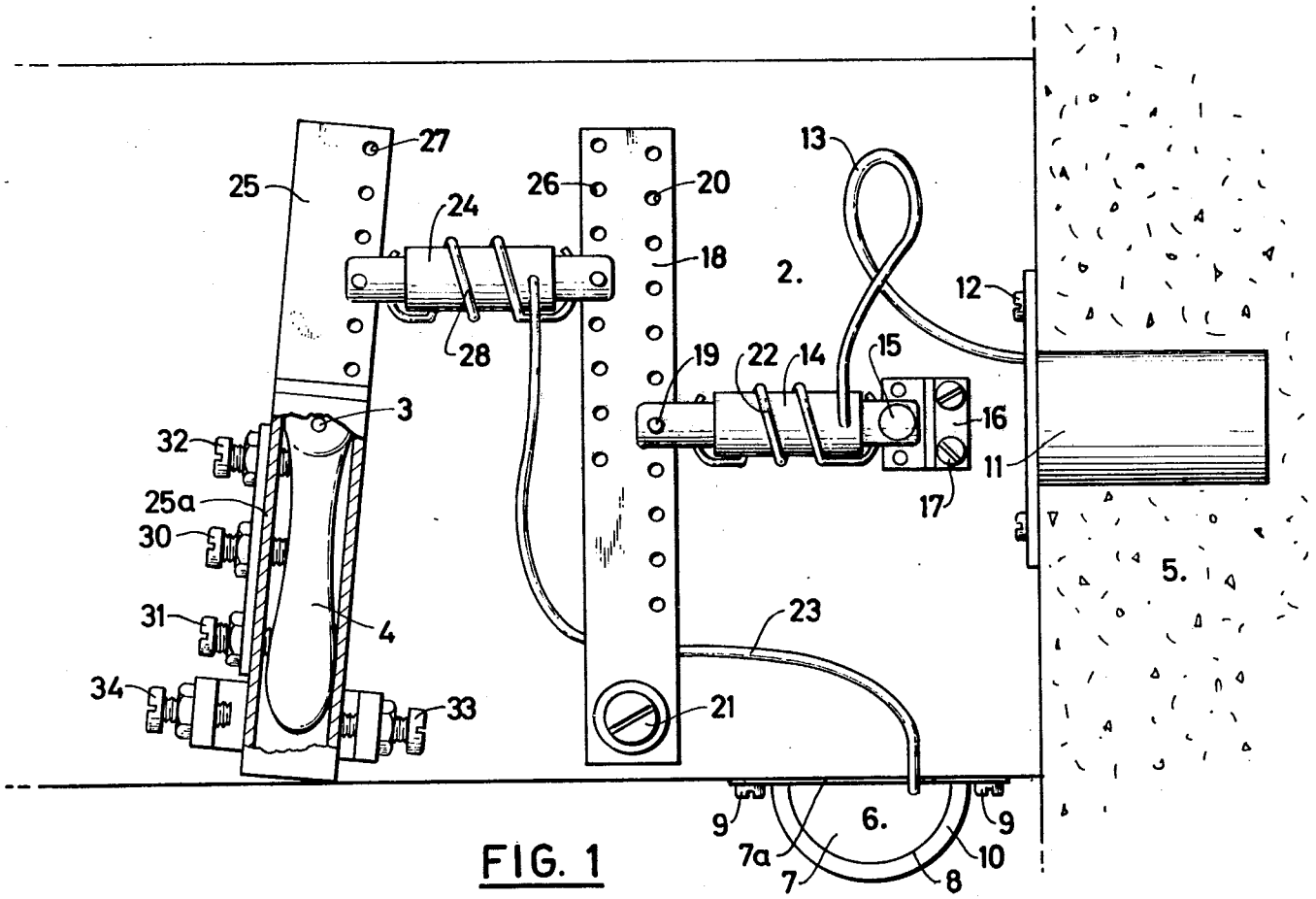
Figure 2:
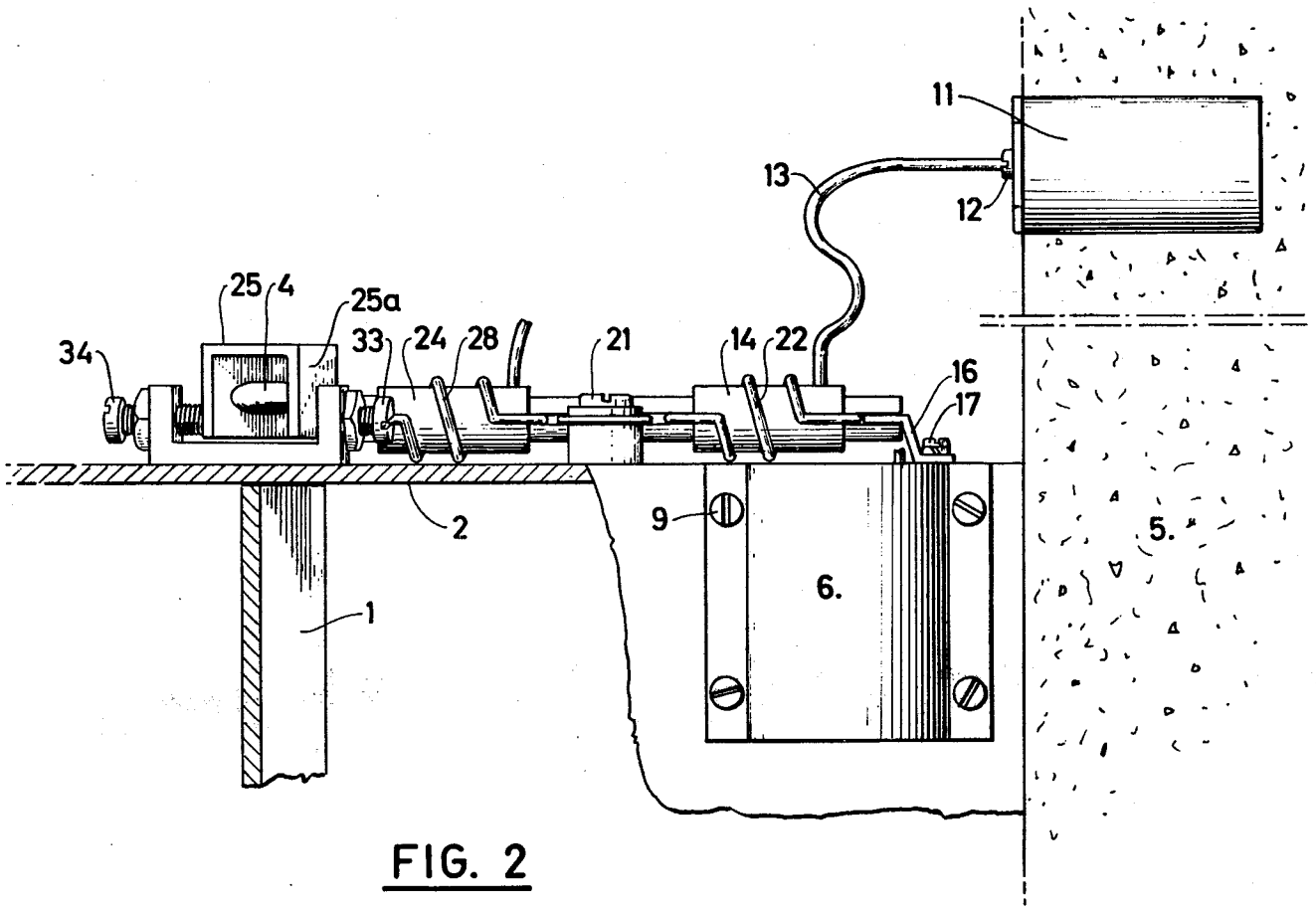

An embodiment of the invention is described in the following, reference being made to the accompanying drawings, in which FIG. 1 is a top view of a smoke flue substantially in horizontal direction departing from the furnace and a cross sectional view of a portion of the wall of an adjacent chimney, with which the smoke exhaust pipe in question is in communication, and FIG. 2 is a view of the same device as seen at right angle to the view illustrated in FIG. 1, the smoke exhaust pipe being shown in a partly sectional view.

In FIG. 2 a smoke exhaust valve located in a smoke flue 2 in a substantially horizontal direction departing from a furnace not shown in the drawing is indicated with 1, said exhaust valve being pivotable round a vertical shaft 3 of central location. The exhaust valve is rigidly connected with said shaft, which on the top side of the smoke flue 2 supports a maneuvering arm 4 extending in the transverse direction of the smoke flue. The smoke flue 2 comprises a metal tube, which in the illustrated embodiment exhibits a rectangular cross section. The tube 2 is laterally connected with a vertical chimney wall 5 and communicates with a pipe located in the wall, but not shown in the drawings. A semicylindrical recipient for fluid is indicated with 6, one diametrically extending lateral wall 7 of which outside of the curved wall 8 of the recipient blending into longitudinal fastening flanges *7a*, through which a number of fastening screws 9 extend into the wall of the smoke flue 2 keeping the flat wall of the recipient for fluid 6 in tight contact with the smoke flue pipe, thus making an effective heat transmission from the smoke exhaust pipe to a liquid enclosed in the recipient 6 possible. However, the other walls of the recipient 6 are coated with a heat insulating layer 10. A second recipient for liquid is indicated with 11 and is in heat transmitting contact with the chimney wall, in which in the embodiment illustrated it is embedded, and is by means of screws 12 attached to the outside of said wall. The sensor unit can within the scope of the invention also be mounted on the chimney wall on the outside of the same. The recipient 11 via a duct 13 communicates with the interior of a piston-cylinder unit 14, which with one of its ends is pivotable round a pin 15 mounted on a holder 16, which by means of fastening screws 17 is mounted on the outside of the exhaust pipe. The other end of the piston-cylinder unit is pivotably connected with an arm 18 at the point 19, which can be displaced along the arm 18 and consequently coincide with the desired number of fastening holes 20 of a total of such holes interspaced along the same. The arm 18 is pivoted on the smoke flue pipe by means of a fastening screw 21 and a bearing bushing surrounding the same. The piston-cylinder unit is further provided with a return spring 22 of tension type, which constantly tends to return the piston-cylinder unit to its contracted condition. The recipient 6 for liquid via a duct 23 communicates with a second piston-cylinder unit 24, of which one end is pivotably connected with the arm 18, its other end being connected with a second arm 25. One end of the piston-cylinder unit 24 can be displaced between a number of holes 26 for attachment on the arm 18, and its other end can be displaced between a number of corresponding holes 27 of attachment on the other arm 25. As in the piston-cylinder unit described above, also the piston-cylinder unit 24 exhibits an external tension spring 28, which tends to compress the same. One end portion of the arm 25 exhibits a U-shaped cross-section thus forming a chute by means of which it grips aroung the maneuvering arm 4 provided on the exhaust valve. The arm 25 is firmly held to the arm 4 of the exhaust valve by means of a number of fastening screws 30–32 screwed through one of its lateral flanges 25*a*. The pivoting centre of the arm 25 thus coincides with the shaft 3 of the exhaust valve. Furthermore the extreme positions of its pivoting movement are defined by a stop dog provided on each side, said stops comprising adjustable screws 33 and 34 respectively.

During the heating-up period of the smoke flue pipe 2 an effective transmission of heat takes place to the recipient 6 for liquid, which thus in an efficient manner senses the temperature in the smoke flue pipe and on account of a volumetric change of the liquid actuates the piston-cylinder unit 24, which thus is prolonged or shortened according to the degree of heating-up of the sensoring unit formed by the recipient 6 for liquid. In a similar manner the piston-cylinder unit 14 is actuated by a volumetric change of the liquid enclosed in the recipient 11 for liquid. The recipient 11 for liquid thus forms a sensoring unit, which is influenced by the temperature ruling in the wall of the chimney. By the coupling together of the two piston-cylinder units the exhaust valve is given a movement, which corresponds to the combined movement of the piston-cylinder units 14 and 24. By means of an adjustment of the attachment of the two piston-cylinder units to the respective arms, the magnitude of influence of each one of the piston-cylinder units on the smoke exhaust valve can be adjusted relative to normal changes of temperature and the volume of the sensoring units 6 and 11 respectively.

According to a simplified embodiment the two piston-cylinder units can of course be directly coupled one after the other, i.e. without the interspaced arm 18. It is also within the scope of the invention to let both the ducts 13 and 23 debouch in a common cylinder unit. However, the embodiment showed offers a greater possibility of choice with regard to the transmission ratio of the transmission of motion from the piston-cylinder unit to the exhaust valve 1.

The sensor unit 11 provides a regulation of the exhaust valve and thereby an adjustment of the draft in the chimney according to the ruling temperature in the same. Before the ignition the smoke flue pipe 2 is comparatively cold, the opening of the exhaust valve then being large. After the ignition the smoke flue pipe is relatively rapidly heated up and thereby also the sensoring unit 6, which after a suitable adjustment of the setting makes possible an automatic diminution of the opening of the exhaust valve during the heating-up period and thereby also a maintenance of ideal draft conditions for the combustion. Because thereof a comparatively high degree of efficiency is obtained by means of the device according to the invention, which in its turn results in a low fuel comsumption. Thus, the sensor unit 6 senses fluctuations of the temperature in the smoke flue pipe 2 rapidly arising in connection with the intermittent operating conditions of the burner at the same time as the sensoring unit 11 senses the variations of temperature in the chimney wall, which are of a more slow nature.

The invention is not limited to the embodiment described above and illustrated in the drawings by way of example only, but can be varied as to its details within the scope of the following claims without therefore departing from the fundamental idea of the invention. Thus it is not necessary that the registrations of the sensoring units are transmitted to the smoke exhaust valve by hydraulic means, it being within the scope of the invention to transmit this registration by mechanical or electrical means. It is also an advantage with the device described above and illustrated in the drawings that it does not exhibit any details projecting into the smoke flue, which could obstruct the work in connection with by way of example sweeping.

I claim:

1. Device for automatic draft control of a furnace having an oil burner, a smoke flue, and an exhaust valve located in the smoke flue, part of the smoke flue located nearest after the exhaust valve as counted in the direction of the exhaust comprising a metal tube which is connected with the wall of a chimney, said device comprising a first sensoring device provided on said metal tube and subjected to the influence of the temperature prevailing in said tube, means for the transmission of the registration of the first sensoring device to the exhaust valve, a second sensoring device provided in said chimney wall, and means for the transmission of the registration of the second sensoring device to the exhaust valve, said first and second sensoring devices being connected with the exhaust valve in such a manner that the combined registration of said sensoring devices is transmitted to the exhaust valve so that said valve can be moved in a shutting-off direction upon an increased temperature in the smoke flue and in a reverse direction when the temperature is decreasing.

2. Device according to claim 1, wherein said first sensoring device comprises a closed recipient for liquid, the volumetric change of the liquid being utilized for the actuation of the exhaust valve.

3. Device according to claim 1, wherein said first and second sensoring devices communicate via hydraulic ducts with a maneuvering unit of a piston-cylinder type coupled to the exhaust valve.

4. Device according to claim 3, wherein said first and second sensoring devices each are coupled to a separate piston-cylinder maneuvering unit.

5. Device according to claim 4, wherein said piston-cylinder maneuvering units are coupled together and with the exhaust valve via pivoting arms extending transversely to said units.

6. Device according to claim 2, wherein said closed recipient has one of its sides in direct contact with the metal tube, the other sides of said closed recipient being heat-insulated from the environment.

7. Device according to claim 1, wherein said second sensoring device is in heat conducting contact with said chimney wall.

* * * * *